US005671577A

United States Patent [19]

Todd

[11] Patent Number: 5,671,577

[45] Date of Patent: Sep. 30, 1997

[54] ROOFING SHINGLE

[75] Inventor: Kenneth L. Todd, Belleville, Mich.

[73] Assignee: MASCO Corporation, Taylor, Mich.

[21] Appl. No.: 469,138

[22] Filed: Jun. 6, 1995

[51] Int. Cl.[6] ..... E04D 1/12

[52] U.S. Cl. ..... 52/519; 52/522; 52/536; 52/538; 52/539; 52/542; 52/590.2; 52/302.1

[58] Field of Search ..... 52/519, 520, 522, 52/536, 538, 539, 542, 540.2, 588.1, 590.1, 747.1, 748.1, 392, 302.1

[56] References Cited

U.S. PATENT DOCUMENTS

| | | |
|---|---|---|
| Re. 24,828 | 5/1960 | Beckman et al. . |
| 420,263 | 1/1890 | Bowers et al. . |
| 527,431 | 10/1894 | Lesmeister . |
| 537,732 | 4/1895 | Thomann . |
| 1,128,836 | 8/1915 | McVoy . |
| 1,326,054 | 12/1919 | Hicks . |
| 2,370,803 | 3/1945 | Kronenbitter . |
| 2,856,647 | 10/1958 | Beckman et al. . |
| 3,091,898 | 6/1963 | Fasold et al. . |
| 4,754,589 | 7/1988 | Leth . |

*Primary Examiner*—Robert Canfield

*Attorney, Agent, or Firm*—Edgar A. Zarins; Malcolm L. Sutherland

[57] ABSTRACT

A fully interlocking roof shingle for installing a weatherproof roof on a building. The shingles are constructed of multiple layers to expose various interlocking grooves for connection to the contiguous shingle. The interlocking grooves have a dovetail configuration to ensure secure connection of the shingles to form a substantially integral roofing system. The individual shingles include a bottom plate with a plurality of grooves disposed upwardly and a top plate with a plurality of grooves disposed downwardly. The grooves of each plate mate to form the assembled roofing shingle exposing a decorative top surface and a base surface of the upper and lower plates respectively. The plates are assembled in an offset manner so as to expose upwardly disposed grooves along two edges and downwardly disposed grooves along the other two edges. As a result, the shingles may be assembled on the roof by interlocking the grooves of the shingles. Apertures for nailing the shingle to the roof are also formed in the shingle.

13 Claims, 3 Drawing Sheets

ROOFING SHINGLE

BACKGROUND OF THE INVENTION

I. Field of the Invention

The present invention is directed to a shingle for providing a weather shield for the roof of a building and, in particular, to an interlocking shingle which is positively connected to all contiguous shingles to form an integral coating system.

II. Description of the Prior Art

Because of their exposure to the elements, building roofs are provided with weather proofing to prevent damage to the interior structure. On residential buildings in particular, the roof is provided with a predetermined pitch to allow moisture to run off the roof. Secured to the roof are shingles overlapped in accordance with the roof pitch to direct moisture off the roof. A variety of materials are used as roofing shingles including metal, wood and petroleum based materials. The most widely used shingles are made of asphalt for their durability and ease of installation.

In the typical roofing installation, the shingles are installed beginning at the lowest point on the roof extending out over a bottom edge of the roof. The shingles are mounted in rows with the side edge of each shingle proximate the previous shingle. The shingles are not connected or overlapping as they are secured by suitable fasteners. Subsequent rows of shingles overlap the shingles immediately below. Since there are no connections between the shingles, placement and spacing are left to the installer. Nothing is provided for holding the shingle in position as it is fastened to the roof.

In order to facilitate installation and variation in climate conditions, the widely used asphalt shingles are flexible. However, this flexibility makes them subject to damage from extreme winds which can bend the asphalt shingle until it breaks. This is particularly troublesome in colder climates where the shingle can become brittle and break away. Rigid shingle materials such as shake, clay or metal are susceptible to damage from extreme temperatures and the natural expansion and contraction of building materials.

SUMMARY OF THE PRESENT INVENTION

The present invention overcomes the disadvantages of the prior known roofing systems by providing a shingle which interlocks with the shingles above, below and to each side to ensure optimum spacing and alignment while providing a long lasting roof for the building.

The roofing shingle of the present invention preferably comprises a rigid shingle made of a thermoplastic or thermoset material for extended durability. The shingle as formed includes tongue and groove connectors formed on the facing surfaces of the shingle. The shingle includes a decorative top surface which remains exposed and forms the decorative appearance of the roof. The decorative surface is offset to expose upwardly disposed grooves along two edges and downwardly disposed grooves along two remaining edges of the shingle. These exposed grooves facilitate interlocking of contiguous shingles. The lower surface is provided with a plurality of support ribs to facilitate air flow beneath the shingle.

The grooves for interlocking the shingles are preferably matching half-dovetail tongue and grooves. The downwardly disposed grooves along one edge of a shingle matingly receive the upwardly disposed grooves of the shingle previously mounted to the roof. The grooves for attaching the plates of the shingle have an arrowhead or tree shape for mating with a similarly configured tongue of the other plate. This tongue and groove is more secure to prevent separation of the plates. The plastic construction of the shingle allows simple attachment of the plates.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
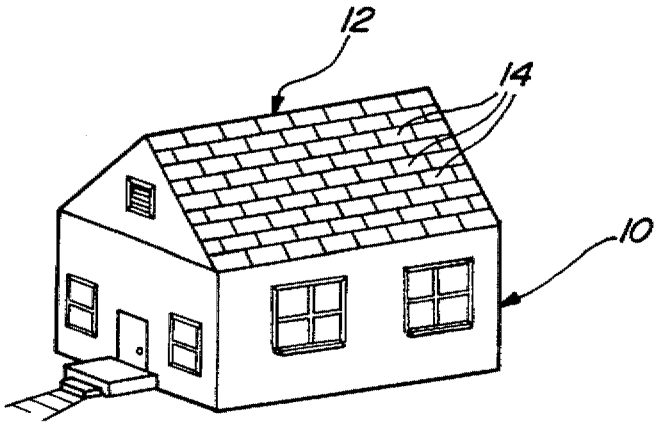
FIG. 1 is a perspective view of a building incorporating a plurality of roofing shingles embodying the present invention.
Figure 2:
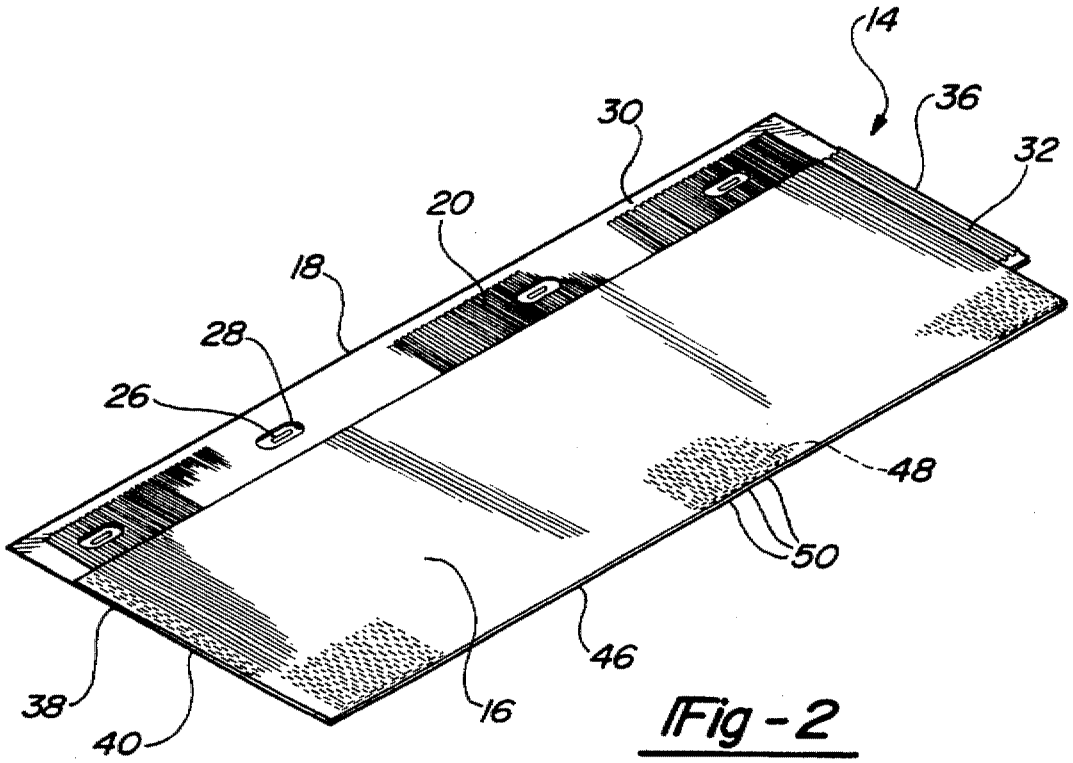
FIG. 2 is a perspective view of a shingle of the present invention.
Figure 3:
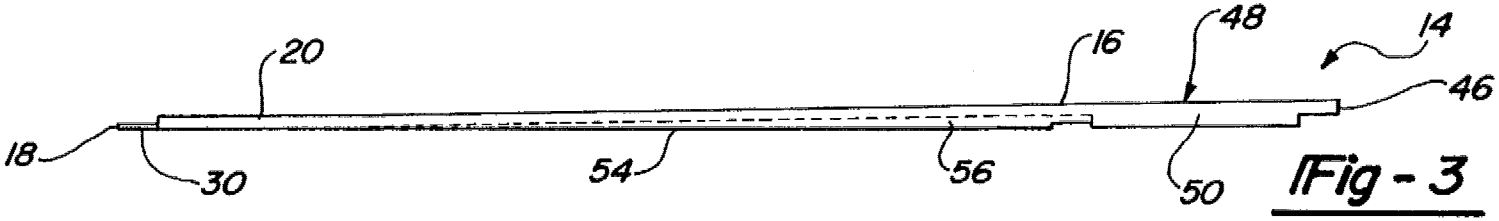
FIG. 3 is an end view of the shingle.
Figure 4:
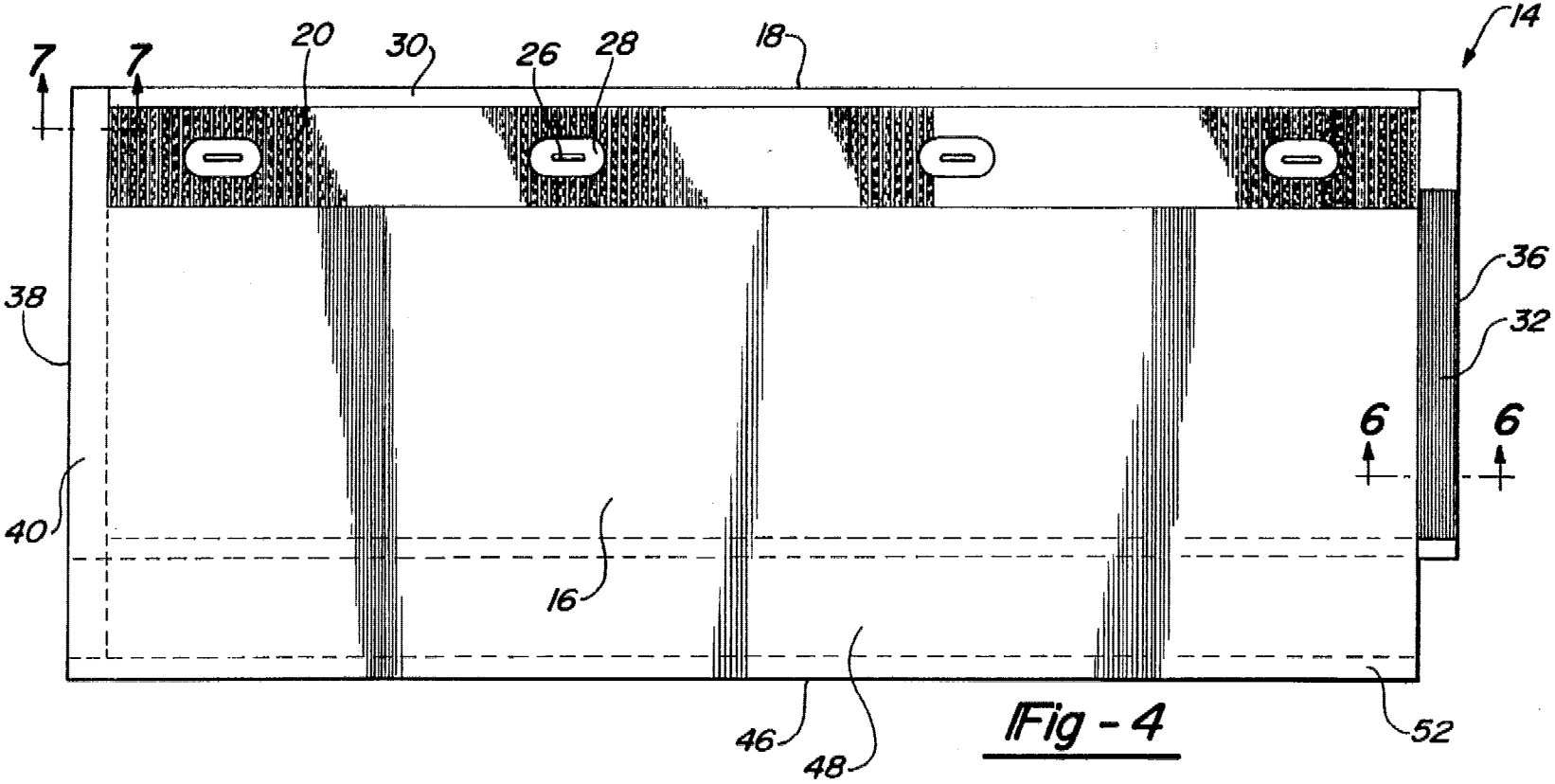
FIG. 4 is a plan view of the shingle.

Referring first to FIGS. 1 and 3, there is shown a building 10 having a roof 12 with a predetermined pitch. In order to protect the building 10 from the elements, a plurality of shingles 14 are mounted to the roof 12 in accordance with the present invention. The shingles 14 are mounted to the roof 12 using roofing nails or other suitable fasteners. Under well known construction techniques, the shingles 14 are first mounted along the bottom edge of the roof 12 with subsequent rows applied so as to overlap the lower previously mounted row of shingles. By overlapping the shingle, moisture is directed off the roof without flowing beneath the shingles 14.

Referring now to FIGS. 2 through 7, the shingle 14 is preferably formed of a rigid or semi-rigid thermoplastic and includes a decorative outer surface 16 which is the portion of the shingle 14 exposed to view after mounting. The decorative surface 16 may be a simple smooth surface or may incorporate a variety of patterns or textures molded directly into the outer surface 16. However, the outer decorative surface 16 does not form the entire outer face of the shingle. Along a top edge 18 of the shingle 14 is formed an upwardly disposed first tongue & groove section 20. This first tongue & groove section 20 incorporates a plurality of "tree-shaped" tongues and grooves 22 (FIG. 7) having longitudinal ridges 24 for locking with the next shingle as will be subsequently described. The first tongue & groove section 20 extends substantially the length of the top edge 18 and has formed therein at least one fastener aperture 26 for receiving a roofing nail or the like. The fastener apertures 26 include a recessed area 28 to receive the head of the nail fastener. Along the top edge 18 of the shingle 14 proximate the first tongue & groove section 20 is a reduced width flange 30 which facilitates the overlapping of the shingles 14. The shingle 14 has the appearance of outer and inner layers offset to expose the tongue and groove sections which facilitate interlocking engagement of the shingles. Although layered in appearance, in a preferred embodiment of the shingle 14 the entire shingle is integrally molded to the desired configuration.

Figure 6:
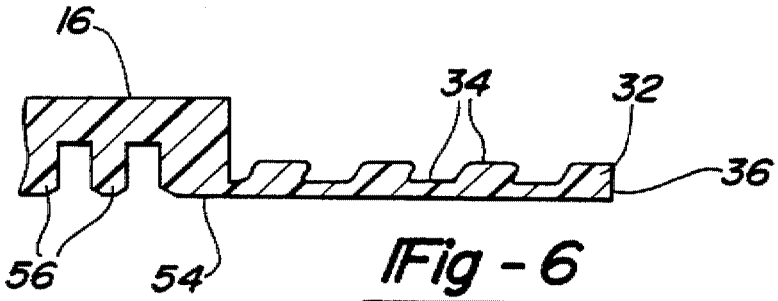
FIG. 6 is an enlarged cross-sectional perspective taken along lines 6—6 of FIG. 4.
Figure 7:
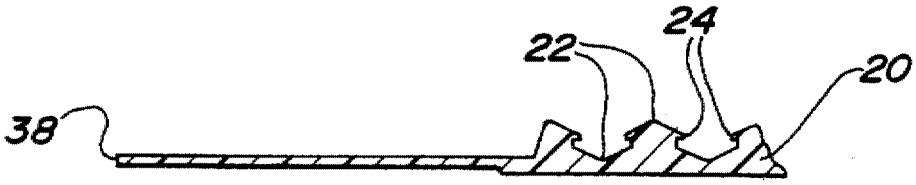
FIG. 7 is an enlarged cross-sectional perspective taken along lines 7—7 of FIG. 4.

A second tongue & groove section 32 with upwardly disposed tongues and grooves 34 (FIG. 6) is formed along a side edge 36 of the shingle 14. Although the upwardly disposed tongue & groove section 32 may be formed along either edge, in a preferred embodiment the second section 32 is formed along the right side edge 36. This will require that the shingles 14 be mounted in their rows moving from left to right along the roof 12. As best shown in FIG. 6, the tongues and grooves 34 have an angled or half-dovetail configuration. As will be subsequently described, the second tongue & groove section 32 is designed to matingly connect to a downwardly disposed section of the contiguous shingle 14. The half-dovetail configuration of the tongues and grooves 34 allow the shingles to be slid together assuring proper spacing between shingles.

Figure 5:
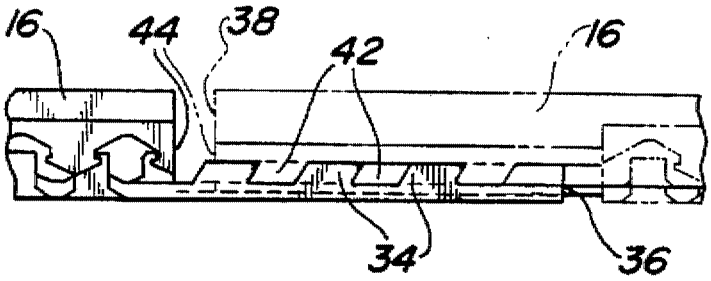
FIG. 5 is an enlarged cross-sectional perspective of the mating connection between contiguous shingles.

The opposite (left) edge 38 of the shingle 14 includes complementary configured but downwardly disposed third tongue & groove section 40. The third tongue & groove section 40 incorporates a plurality of angled or half-dovetail tongues and grooves 42. Each of these tongues and grooves 42 have a substantially rhomboidal cross-sectional configuration. FIG. 5 illustrates the mating arrangement between the upwardly disposed tongues and grooves 34 of the second section 32 with the downwardly tongues and grooves 42 of the third section 40 of the next shingle 14. The tongue & groove sections 32,40 are arranged so as to form a gap 44 between decorative surfaces 16 of the shingles 14. In a preferred embodiment, this gap 44 is one-tenth of an inch.

Formed along a bottom edge 46 of the shingle 14 is a downwardly disposed fourth tongue & groove section 48. The fourth tongue & groove section 48 has a plurality of "tree-shaped" tongues and grooves 50 adapted to matingly engage the tongues and grooves 22 of the first section 20. The tree-shaped tongues and grooves of the first tongue and groove section 20 and the fourth section 48 matingly engage by locking the substantially triangular outer ends with the longitudinal ridges. The ridged or tree-shaped configuration of the tongue and grooves 50 are snapped into locking engagement with the first section 20 of a previously mounted shingle 14 to ensure that the shingles are secured together. An overhang 52 is formed along the very edge 46 to ensure proper coverage. As a result, each subsequently mounted shingle 14 will overlap the top portion of the shingles 14 immediately below the shingle 14 to direct water flow down the roof 12.

In a preferred embodiment, the underside 54 of the shingle 14 is provided with a plurality of support ribs 56 to permit air flow beneath the shingle 14 but prevent sagging in the top decorative surface 16 of the shingle 14. The ribs 56 extend vertically along the underside and are formed along the undersurface except where downwardly disposed tongue & groove sections are formed.

Mounting of the shingles 14 forms a substantially integral roofing assembly because of the interconnection of all the shingles 14. A starter strip (not shown) may be used to form a fastening point along the lower edge of the roof 12. The starter strip may incorporate the nail holes 26 and upwardly disposed tongue & grooves of shingle 14. Beginning preferably at the lower left corner of the roof 12, a row of shingles 14 is mounted by attaching the fourth tongue & groove section 48 to the starter strip and nailing the upper edge of the shingle 14 using nail holes 26. As the next shingle 14 of the row is mounted, the third tongue & groove section 40 is mounted to the second tongue & groove section 32 of the fixed shingle 14. Each subsequent shingle 14 will be mounted along its bottom edge 46 and its left side edge 38 to previously mounted shingles 14 and then nailed to the roof 12. The completed shingled roof will have only the decorative surface 16 exposed providing a uniform appearance. Mounting of the shingles 14 and interconnection to provide an integral roofing system is facilitated by the complementary tongue and grooves section of the first and fourth sections and the second and third sections of the shingle. Accordingly, the complementary tongue and grooves ensure proper connection of the shingles to form the roof of the building.

The foregoing detailed description has been given for clearness of understanding only and no unnecessary limitations should be understood therefrom as some modifications will be obvious to those skilled in the art without departing from the scope and spirit of the appended claims.

What is claimed is:

1. A roofing system incorporating a plurality of roofing shingles, said shingles arranged on a roof of a building partly overlapped by and partly overlapping adjacent roofing shingles to provide a substantially water impervious barrier for the building roof, said roofing system comprising:

a plurality of shingles each having an integral body having an inner surface engaging the roof of the building and an outer surface exposed to form a decorative surface area of the building roof upon application of said shingles, said shingle body including first and second edge sections having outwardly disposed interlocking means and third and fourth edge sections having inwardly disposed interlocking means;

said interlocking means of said first and fourth edge sections having complementary interlocking ribs, said interlocking ribs of said first and fourth edge sections having a substantially triangular outer end with longitudinal locking ridges for selective mating engagement with an adjacent shingle;

said interlocking means of said second and third edge sections having complementary tongue and grooves, said tongue and grooves of said second and third edge sections having a substantially dove-tail cross-sectional configuration for selective mating engagement with an adjacent shingle;

wherein said inwardly disposed interlocking means of said fourth edge section lockingly mates with said outwardly disposed interlocking means of a first overlapped adjacent shingle, said inwardly disposed interlocking means of said third edge section lockingly mates with outwardly disposed interlocking means of a second overlapped adjacent shingle, said outwardly disposed interlocking means of said second edge section lockingly mates with inwardly disposed interlocking means of a first overlapping adjacent shingle and said outwardly disposed interlocking means of said first edge section lockingly mates with inwardly disposed interlocking means of a second overlapping adjacent shingle.

2. The system as defined in claim 1 and further comprising at least one aperture formed in each said first edge section for receiving means for fastening said shingles to the roof.

3. The system as defined in claim 1 wherein said first and second edge sections are disposed outside the circumference of said outer surface, said outer surface raised above said first and second edge sections.

4. The system as defined in claim 3 wherein said third and fourth edge sections are disposed outside the circumference of said inner surface.

5. The system as defined in claim 1 wherein said inner surface of said integral body includes a plurality of ribs, said ribs engaging the building roof while facilitating air flow beneath said shingles.

6. The system as defined in claim 1 wherein said shingles are made of a thermoplastic material for a substantially rigid construction.

7. A roofing system incorporating an integral roofing shingle, said shingle arranged on a roof of a building partly overlapped by and partly overlapping adjacent roof shingles to provide a substantially water impervious barrier for the building roof, said roofing system comprising:

a plurality of shingles each having an integral body having an inner layer with an inner surface engaging the roof of the building and an outer layer having an outer surface exposed to form a decorative surface area of the building roof upon application of said shingles, said shingle body including first and second edge sections having outwardly disposed interlocking means formed on said inner layer outside the circumference of said outer layer and third and fourth edge sections having inwardly disposed interlocking means formed on said outer layer outside the circumference of said inner layer;

said interlocking means of said first and fourth edge sections having complementary interlocking ribs having a cross-sectional configuration with a base and a substantially triangular outer head having longitudinal locking ridges;

said interlocking means of said second and third edge sections having complementary tongue and grooves with a substantially dove-tail cross-sectional configuration;

wherein said inwardly disposed interlocking means of said fourth edge section lockingly mates with outwardly disposed interlocking means of a first overlapped adjacent shingle, said inwardly disposed interlocking means of said third edge section lockingly mates with outwardly disposed interlocking means of a second overlapped adjacent shingle, said outwardly disposed interlocking means of said second edge lockingly mates with inwardly disposed interlocking means of a first overlapping adjacent shingle, and said outwardly disposed interlocking means of said first edge section lockingly mates with inwardly disposed interlocking means of a second overlapping adjacent shingle whereby only said outer surface is exposed to form the impervious barrier for the building roof.

8. The system as defined in claim 7 and further comprising at least one aperture formed in each said first edge section for receiving means for fastening said shingles to the roof.

9. The system as defined in claim 7 wherein said shingles are molded of a thermoplastic material for a substantially rigid integral construction.

10. The system as defined in claim 9 wherein said inner surface of said integral body includes a plurality of ribs, said ribs engaging the building roof while facilitating air flow beneath said shingle.

11. An integral roofing shingle adapted to be arranged on a roof of a building to provide a substantially water impervious barrier for the building roof, said shingle comprising:

an integral body having an inner surface engaging the roof of the building and an outer surface exposed to form a decorative surface area, said shingle body including first and second edge sections having outwardly disposed interlocking means and third and fourth edge sections having inwardly disposed interlocking means;

said interlocking means of said first and fourth edge sections have complementary interlocking ribs, said interlocking ribs of said first and fourth edge sections having a substantially triangular outer end with longitudinal locking ridges;

said interlocking means of said second and third edge sections have complementary tongue and grooves, said tongue and grooves of said second and third edge sections having a substantially dove-tail cross-sectional configuration.

12. The shingle as defined in claim 11 wherein said inner surface of said integral body includes a plurality of ribs, said ribs adapted to engage the building roof while facilitating air flow beneath said shingle.

13. The shingle as defined in claim 11 and further comprising at least one aperture formed in said first edge section for receiving means for fastening said shingle to the roof.

* * * * *